United States Patent [19]

Godfrey

[11] Patent Number: 4,862,812

[45] Date of Patent: Sep. 5, 1989

[54] WINDOW TRAY ASSEMBLY

[76] Inventor: Charles E. Godfrey, P.O. Box 68, Reading, Mass. 01867

[21] Appl. No.: 187,455

[22] Filed: Apr. 28, 1988

[51] Int. Cl.[4] ..... A47B 9/00

[52] U.S. Cl. ..... 108/47; 248/236; 211/150; 211/90; 211/113; 49/171

[58] Field of Search ..... 108/47, 46, 45, 90, 108/97, 100, 42; 248/236, 208; 211/99, 102, 150, 90, 1.3, 80; 312/322, 323, 282; 49/70

[56] References Cited

U.S. PATENT DOCUMENTS

| | | | |
|---|---|---|---|
| 766,208 | 8/1904 | Williams | 108/97 |
| 1,321,869 | 11/1919 | Wilson | 248/236 X |
| 1,576,034 | 3/1926 | Butt | 211/90 X |
| 1,733,485 | 10/1929 | Desrosiers | 248/208 X |
| 1,790,468 | 1/1931 | Frank et al. . | |
| 1,887,102 | 11/1932 | Mathie . | |
| 2,878,945 | 3/1959 | Speir | 211/88 |
| 2,966,272 | 12/1960 | MacKenzie | 108/47 |
| 3,706,105 | 12/1972 | Nicholas et al. | 248/236 X |
| 4,001,970 | 1/1977 | Miyamoto | 49/171 |
| 4,108,086 | 8/1978 | Yindra | 108/157 |

FOREIGN PATENT DOCUMENTS

| | | | |
|---|---|---|---|
| 2219701 | 9/1974 | France | 211/1.3 |
| 610716 | 10/1948 | United Kingdom | 211/102 |

*Primary Examiner*—Kenneth J. Dorner
*Assistant Examiner*—José V. Chen

[57] ABSTRACT

A window tray assembly comprising a vertical wall having a window therein, a lower margin of the window being defined by a sill, and a planar tray member adapted to be moved from a position parallel to the wall and removed from the window to a position in the window overlying and resting upon the sill, to provide a horizontal tray surface on the window sill.

4 Claims, 2 Drawing Sheets

WINDOW TRAY ASSEMBLY

BACKGROUND OF THE INVENTION

1. Field of the Invention

This invention relates to a folding tray and is directed more particularly to a tray assembly for use in conjunction with a window in a wall.

2. Description of the Prior Art

In the course of enjoying back-yard activities, it often happens that items desired for serving of food or refreshments in the back-yard are passed from a window in a house, typically a kitchen window, to a server out of doors. In most instances it is necessary that the items passed through the window be handed from one person to another because the window sill is usually rather small, often not entirely planar, and often not horizontal, but at a sloping angle. Accordingly, simply leaving plates, glasses, foodstuffs, and the like on the window sill for later retrieval usually is not practicable, though quite desirable.

SUMMARY OF THE INVENTION

An object of the present invention is to provide a tray assembly which is adapted for use in conjunction with a window and which in one position provides a horizontal surface of convenient size and disposition for retaining goods thereon, and in a second position is in an out-of-the-way location, leaving the window available for ordinary use.

With the above and other objects in view, as will hereinafter appear, a feature of the present invention is the provision of a window tray assembly comprising a vertical wall having a window therein, a lower margin of the window being defined by a sill, a planar tray member, and mounting means for the planar tray member, the mounting means being fixed to the wall and adapted to position the tray in a first position parallel to the wall and removed from the window and, alternatively, to position the tray in a second position in the window overlying and resting upon the sill and generally normal to the wall.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
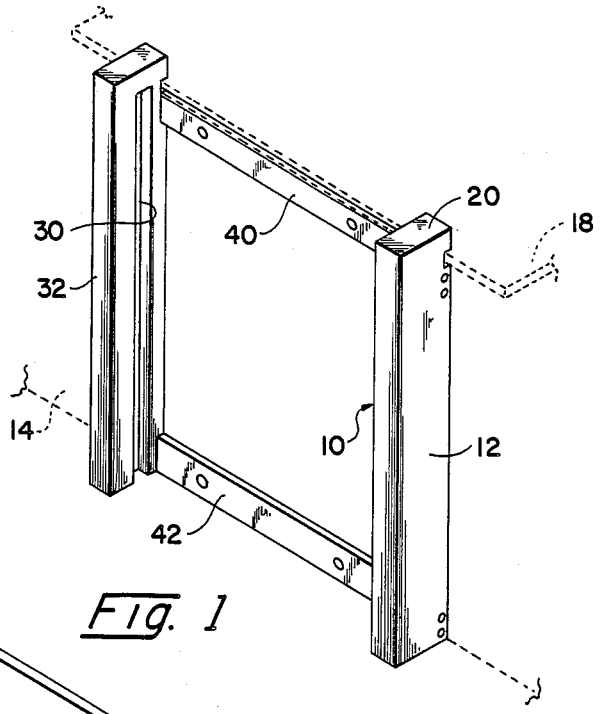
FIG. 1 is a perspective view of a beam means which comprises a portion of the window tray assembly of the present invention.
Figure 3:
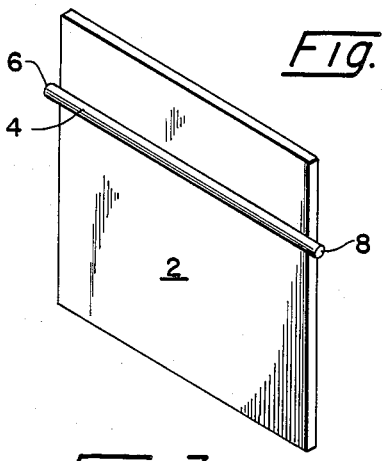
FIG. 3 is a bottom view of the planar tray member and rod of FIG. 2.
Figure 2:
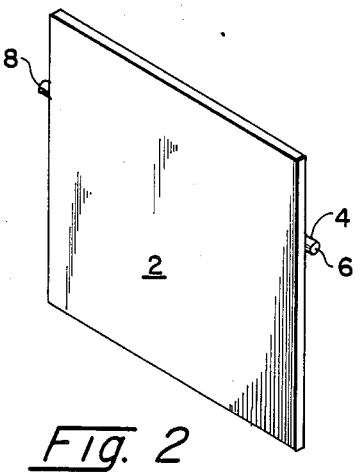
FIG. 2 is a top plan view of a planar tray member and rod which comprise portions of the window tray assembly of the present invention.
Figure 4:
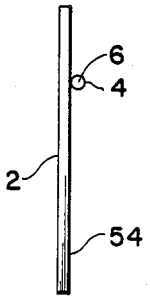
FIG. 4 is a side elevational view of the planar tray member and rod of FIG. 2.

Referring to the drawings, it will be seen that an illustrative embodiment of the invention includes a planar tray member 2 having fixed to one side thereof a rod means 4 which has first and second ends 6, 8 extending beyond edges of the tray member (FIGS. 2–4).

Figure 5:
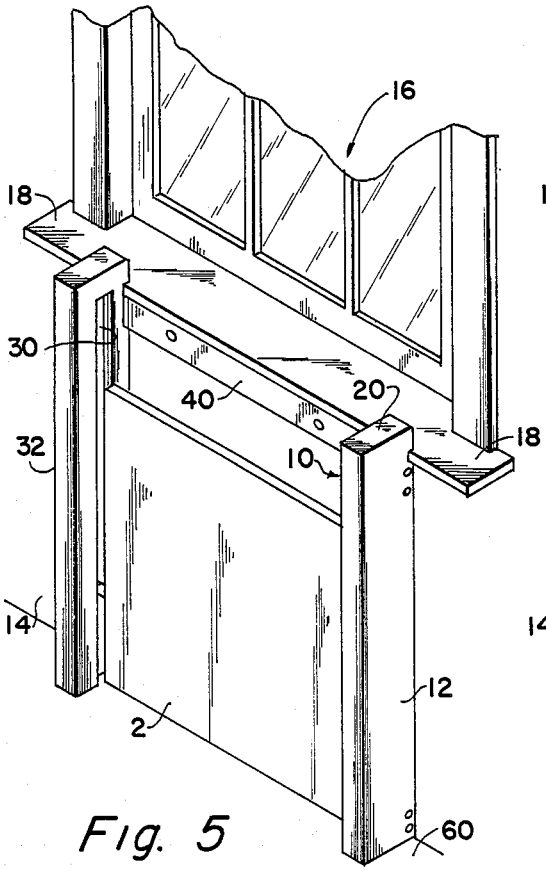
FIG. 5 is a perspective view of one form of a window tray assembly illustrative of an embodiment of the invention, the assembly being shown in a first, inoperative, position.
Figure 6:
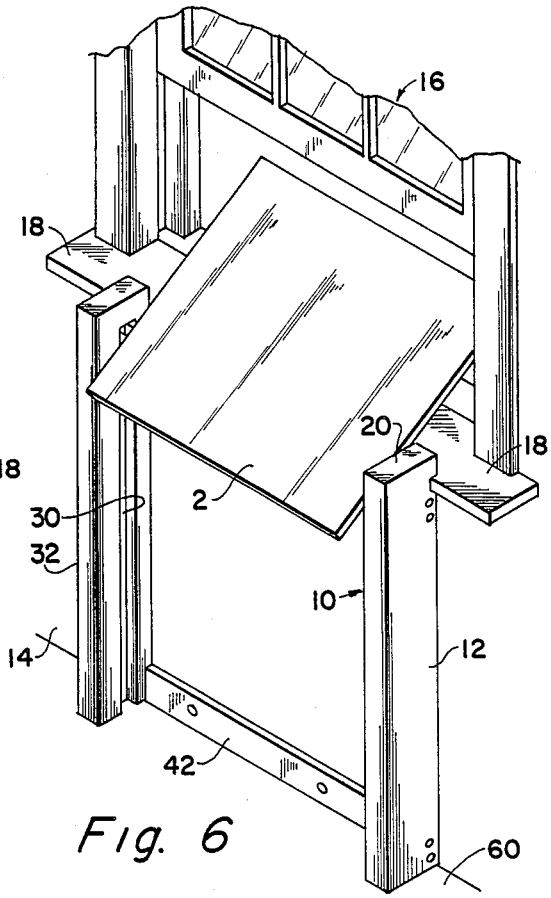
FIG. 6 is a perspective view, similar to FIG. 5, but showing the assembly being moved from the inoperative position of FIG. 5 to an operative position.
Figure 7:
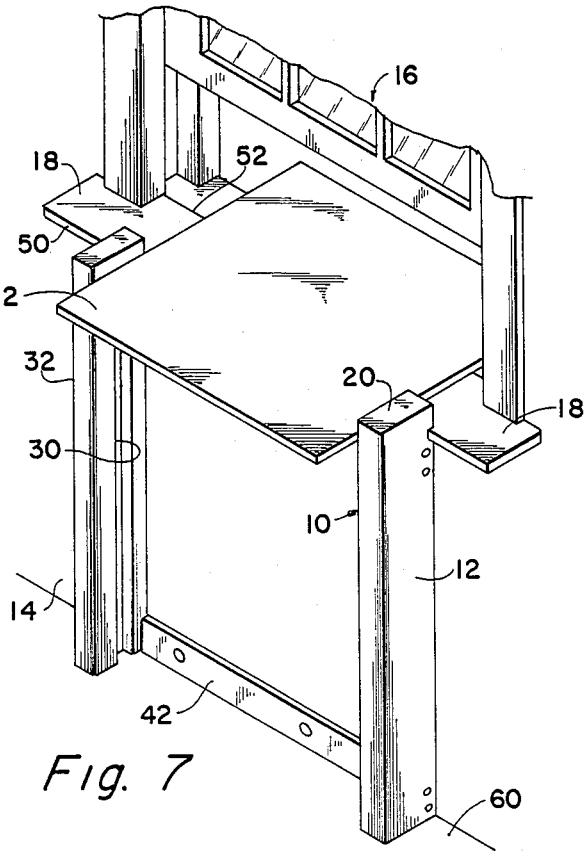
FIG. 7 is a perspective view, similar to FIG. 6, but showing the assembly in its operative position.

The rod first end 6 is disposed in a slot 10 (hidden in FIGS. 1, 5–7) extending lengthwise of a first beam 12 fixed to a wall 14 in which there is a window opening 16 (FIGS. 5–7). The first slot is less in depth than the depth of the first beam 12, such that the first slot comprises a first groove adapted to retain the rod means first end 6. The window opening 16 is defined at its lower margin by a sill 18. An upper end 20 of the first beam 12 extends above the sill 18. From an area proximate the sill 18, the first beam 12 extends vertically downwardly.

In like manner, the rod second end 8 is disposed in a slot 30 extending lengthwise of a second beam 32 fixed to the wall 14, the second beam 32 being parallel to and co-extensive with the first beam 12. The second slot is less in depth than the depth of the second beam 32, such that the second slot comprises a second groove adapted to retain the rod means second end 8.

The rod means 4 is slidably movable in the slots 10, 30 and is also rotatably movable in the slots.

The beams 12, 32 may be interconnected by support members 40, 42. The beams 12, 32 and the support members 40, 42 preferably are fixed to the wall 14. In FIGS. 5–7, the beams 12, 32 are shown extending to a floor 60, with the slots 10, 30 extending to the lower end, respectively, of each beam. In practice, the beams need not extend to the floor, in which case the slots 10, 30 preferably are not open-ended slots. In such embodiment the lower ends of the slots stop the downward movement of the rod 4.

In a first position, as shown in FIG. 5, the tray member 2 is disposed substantially parallel with the wall 14 and removed from the window opening 16. In the first position, the tray is in an out-of-the-way position, enabling use of the window in the usual manner.

Referring to FIG. 6, the tray member 2 may be moved upwardly by sliding the rod ends 6, 8 in the slots 10, 30. When the rod means 4 reaches the upper closed ends of the slots, the rod means 4 and tray member 2 may be pivoted such that the tray member 2 moves from a substantially vertical position to a substantially horizontal position. The upper ends of the slots 10, 30 extend just above the window sill 18, such that when the tray member is moved to the horizontal position, shown in FIG. 7, the tray member is disposed in the window opening, overlying the sill and resting on the sill. For the tray member to easily enter the window and rest upon the sill, it is necessary that the width of the tray member be less than the width of the window. To provide a large enough horizontal surface, it is preferable that the tray member 2 extend well beyond the lengthwise margins 50, 52 of the sill 18 (FIG. 7). The larger portion 54 of the tray member 2 (FIG. 4) rests upon the sill, while the ends 6, 8 of the rod 4 are at the upper ends of the slots 10, 30, giving the tray member stability in its in-use position (FIG. 7).

Thus, there is provided a substantially horizontal planar surface on which may be placed dishes, foodstuffs and refreshments as desired.

After use, the tray may be returned to the position shown in FIG. 5. The tray member 2 may be quickly and easily moved from one position to another.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A window tray assembly comprising a vertical wall having a window opening therein, a sill member defining a lower margin of said window opening, a planar tray member, and mounting means for said planar tray member fixed to said wall, said mounting means comprising a pair of vertical beams, an upper end of each of said beams being disposed in a plane above said sill member, each of said beams having an elongated groove therein, an upper end of each of said grooves being disposed proximate said sill member, said beams extending downwardly beneath said window opening, and rod means fixed to said tray member and disposed in said grooves, said rod means being slidably moveable vertically in said grooves and being rotatively moveable in said upper ends of said grooves to pivotally move said tray member selectively into or out of engagement with said sill member, whereby said mounting means is adapted to position said tray member in a first location parallel to said wall and below said window opening, and alternatively to position said tray member in a second location in said window opening overlying and resting upon said sill and generally normal to said wall.

2. The window tray assembly in accordance with claim 1 in which said rod means extend outwardly beyond margins of said tray member.

3. The window tray assembly in accordance with claim 2 in which said rod means comprises a single rod extending across the width of said tray member and beyond said margins thereof.

4. The window tray assembly in accordance with claim 1 in which when said tray rests upon said sill member, a planar underside of said tray member engages said sill member.

* * * * *